US005653618A

United States Patent [19]

Cheng

[11] Patent Number: 5,653,618

[45] Date of Patent: Aug. 5, 1997

[54] MULTIPURPOSE FLOTATION BLANKET

[76] Inventor: Chun-Ming Cheng, 2F, No. 55, Ping Teng St., Hsin Tien City, Taipei, Taiwan

[21] Appl. No.: 302,973

[22] Filed: Sep. 12, 1994

[51] Int. Cl.[6] ..... B63C 9/08

[52] U.S. Cl. ..... 441/130; 441/40

[58] Field of Search ..... 441/40–42, 35, 441/66, 128, 129, 135, 136

[56] References Cited

U.S. PATENT DOCUMENTS

| | | | |
|---|---|---|---|
| 3,068,494 | 12/1962 | Pinkwater | 441/129 |
| 4,380,239 | 4/1983 | Brown | 440/42 |
| 5,049,102 | 9/1991 | Hull | 441/42 |

*Primary Examiner*—Jesus D. Sotelo

[57] ABSTRACT

A multipurpose flotation blanket including a blanket body formed of two opposite flotation layers peripherally sealed and covered with a water proof covering and defining an inflatable air chamber, a handle unit detachably fastened to the blanket body for carrying by hand when the blanket body is folded up and arranged into the form of a hand bag, and an air valve assembly made on the blanket body for letting air be driven into or out of the air chamber, and wherein when the two opposite flotation layers of the blanket body are pulled apart, a current of air is inducted into the air chamber to inflate the blanket body; the air valve assembly has an inlet nozzle, a plug rod fitted into the inlet nozzle to seal the air passage, and a pull strip connected to the inlet nozzle for pulling the inlet nozzle away from the plug rod.

7 Claims, 4 Drawing Sheets

MULTIPURPOSE FLOTATION BLANKET

BACKGROUND OF THE INVENTION

The present invention relates to a multipurpose flotation blanket which can be used as a blanket for picnics as well as a flotation device for assisting the user in learning swimming and, which can be arranged into the form of a hand bag for carrying things.

Various flotation devices are known and intensively used in water sports. These flotation devices commonly comprise an inflatable air chamber and must be inflated before use or exhausted after use. When a flotation device is inflated, it may be explode when pierced by a pointed object. There are known flotation devices which are not inflatable. However, these non-inflatable flotation are commonly huge and not collapsible. Furthermore, conventional flotation devices of any type do not provide any added functions.

SUMMARY OF THE INVENTION

The present invention has been accomplished under the circumstances in view. It is one object of the present invention to provide a multipurpose flotation blanket which can be easily inflated or collapsed. It is another object of the present invention to provide a multipurpose flotation blanket which can be used as a beach mattress for water sports. It is still another object of the present invention to provide a multipurpose flotation blanket which can be used as a mattress for sitting and lying indoors as well as outdoors. It is still another object of the present invention to provide a multipurpose flotation blanket which can be arranged into the form of a hand bag for carrying things.

To achieve the aforesaid objects, there is provided a flotation blanket comprised of a blanket body formed of two opposite flotation layers peripherally sealed and covered with a water proof covering and defining an inflatable air chamber, a handle unit detachably fastened to the blanket body for carrying by hand when the blanket body is folded up and arranged into the form of a hand bag, and air valve assembly made on the blanket body for letting air be driven into or out of the air chamber. The air valve assembly comprises an inlet nozzle, a plug rod fitted into the inlet nozzle to seal the air passage, and a pull strip connected to the inlet nozzle for pulling the inlet nozzle away from the plug rod. By pulling the two opposite flotation layers of the blanket body apart, a current of air is induced into the air chamber to inflate the blanket body. When the blanket body is inflated, the inlet nozzle is depressed causing the plug rod to insert into the inlet nozzle and to seal the air passage.

DETAILED DESCRIPTION OF THE PREFERRED EMBODIMENT

Figure 1:
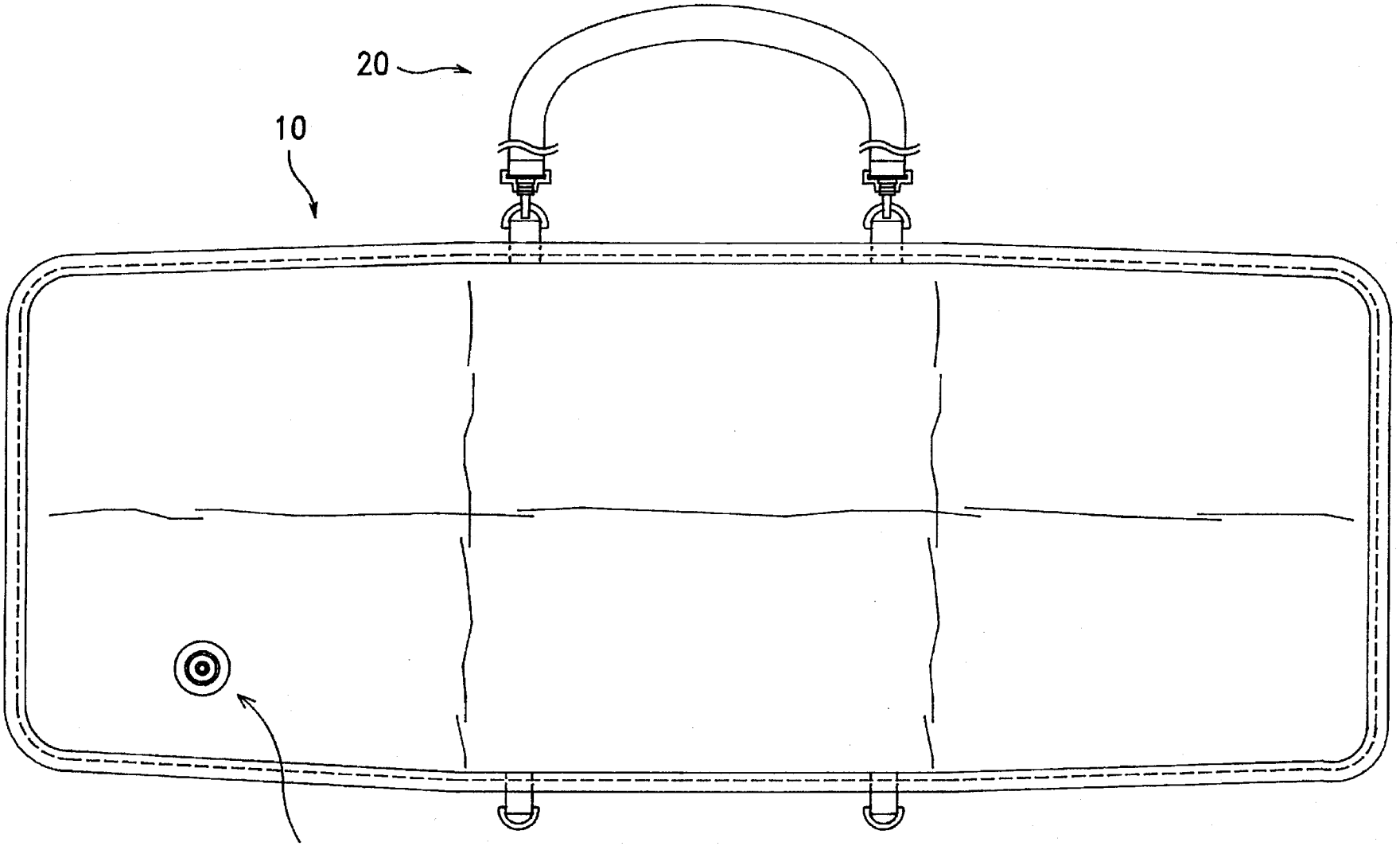
FIG. 1 is an extended-out view of a multipurpose flotation blanket according to the present invention.

Referring to FIG. 1, a multipurpose flotation blanket in accordance with the present invention is generally comprised of a flat, hollow, rectangular blanket body 10, a handle unit 20, and an air valve assembly 30.

Figure 2B:
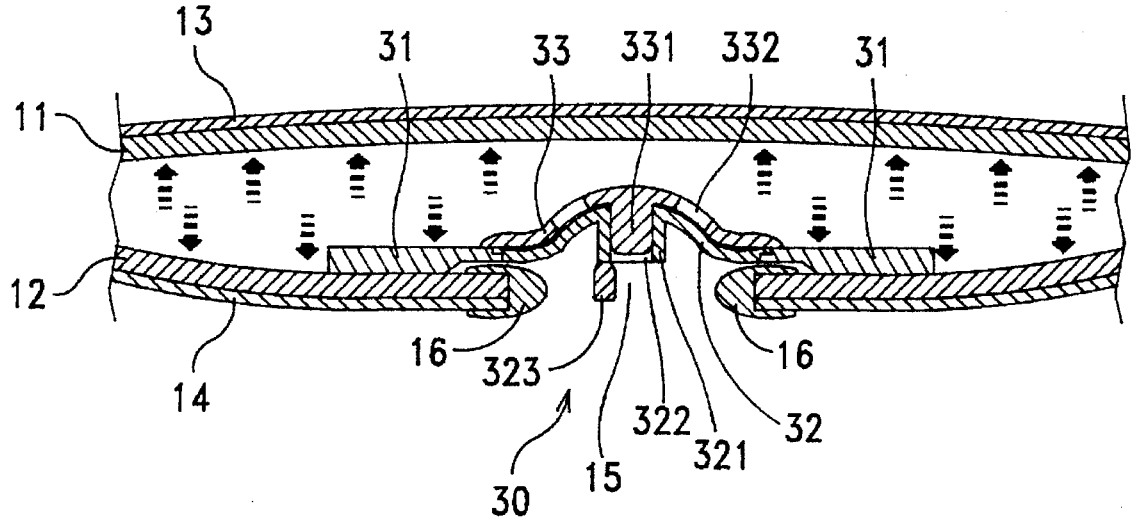
FIG. 2B is similar to FIG 2A, but showing the air valve closed.
Figure 2A:
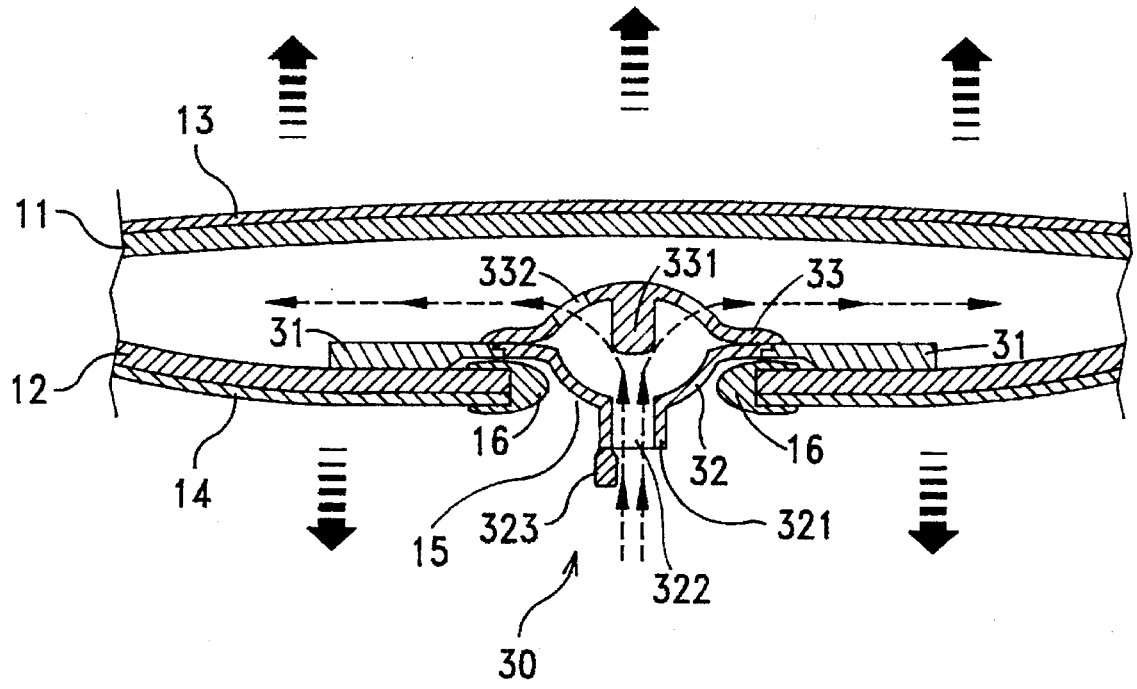
FIG. 2A is a partial view in section of the multipurpose flotation blanket shown in FIG. 1, showing the air valve thereof opened.
Figure 3B:
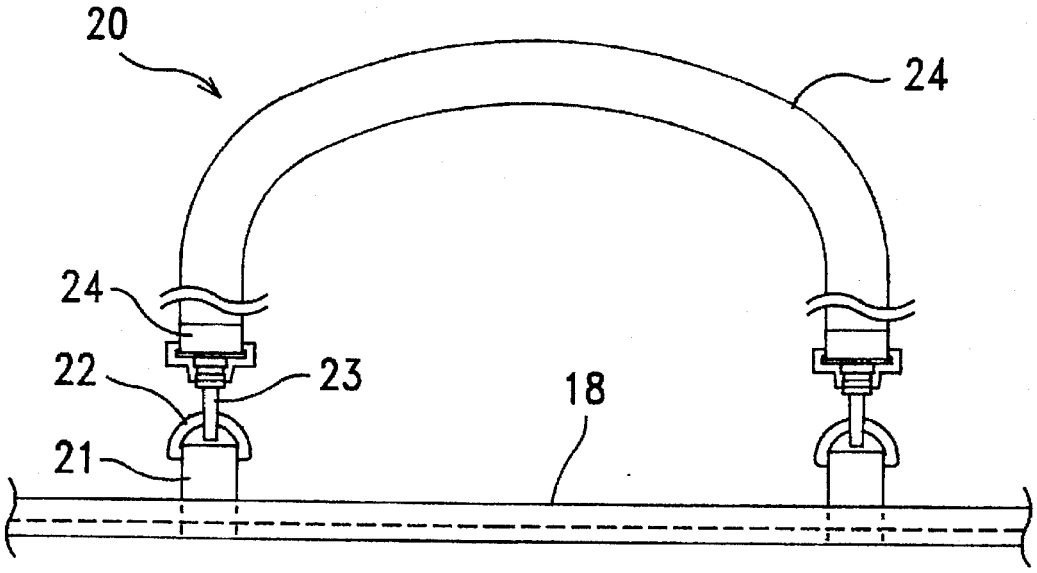
FIG. 3B shows the structure of the carrying handle of the multipurpose flotation blanket according to the present invention.

Referring to FIG. 2A, the blanket body 10 is comprised of an upper flotation layer 11, a bottom flotation layer 12 peripherally sealed to the upper flotation layer 11 and defining with the upper flotation layer 11 and inflatable air chamber, and upper covering 13 covered over the upper flotation layer 11 on the outside, a bottom covering 14 covered over the bottom flotation layer 12 on the outside, and a hem 18 fastened to the upper and bottom flotation layers 11 and 12 and the upper and bottom coverings 13 and 14 around the border by stitches (see also FIG. 3B). The upper and bottom flotation layers 11 and 12 are made from an air-tight material that is flotable. The upper and bottom coverings 13 and 14 are water proof and printed with decorative patterns.

Figure 3A:
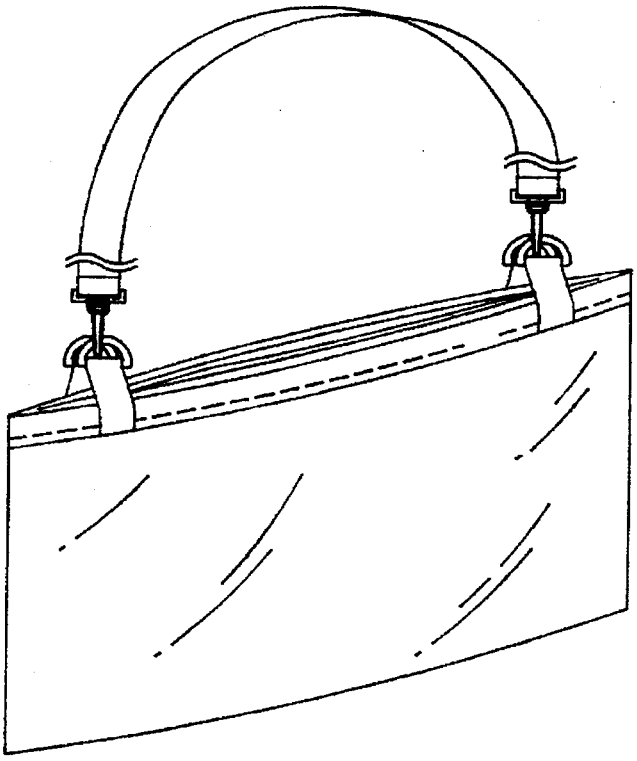
FIG. 3A shows the multipurpose flotation blanket arranged into the form of a hand bag for carrying things.

Referring to FIGS. 3A and 3B and FIG. 1 again, the handle unit 20 comprises two symmetrical pairs of strips 21 respectively fastened to two opposite long sides of the blanket body 10 to hold a respective loop 22, and a handle strap 24 having two hooks 23 at two opposite ends thereof. The multipurpose flotation blanket can be arranged into the form of a hand bag as shown in FIG. 3A by: folding up the length of the blanket body 1 into three folds, then folding up the width of the blanket body 1 into two folds, and then fastening the hooks 23 of the handle strap 24 to the loops 22 on the symmetrical pairs of strips 21.

Referring to FIGS. 2A and 2B again, the air valve assembly 30 is made on the blanket body 10 for letting air be driven into or out of the air chamber defined between the upper and bottom flotation layers 11 and 12. As illustrated, the air valve assembly 30 comprises a protective ring 16 mounted around a circular air passage hole 15 on the blanket body 10, a valve seat 31 made on the bottom flotation layer 12 on the inside around the circular air passage hole 15, a flexible upper valve body 32 connected to the valve seat 31 for controlling the passage of the circular air passage hole 15 and having an inlet nozzle 321 defining an air inlet 322 and a pull strip 323 extended outwards from the inlet nozzle 321, and a lower valve body 33 fastened to the valve seat 31 and disposed inside the air chamber defined between the upper and bottom flotation layers 11 and 12 and having a plug rod 331 for fitting into the inlet nozzle 321 to seal the air inlet 322 and a plurality of air holes 332 for passing of air into or out of the air chamber defined inside the blanket body 10.

Figure 4:
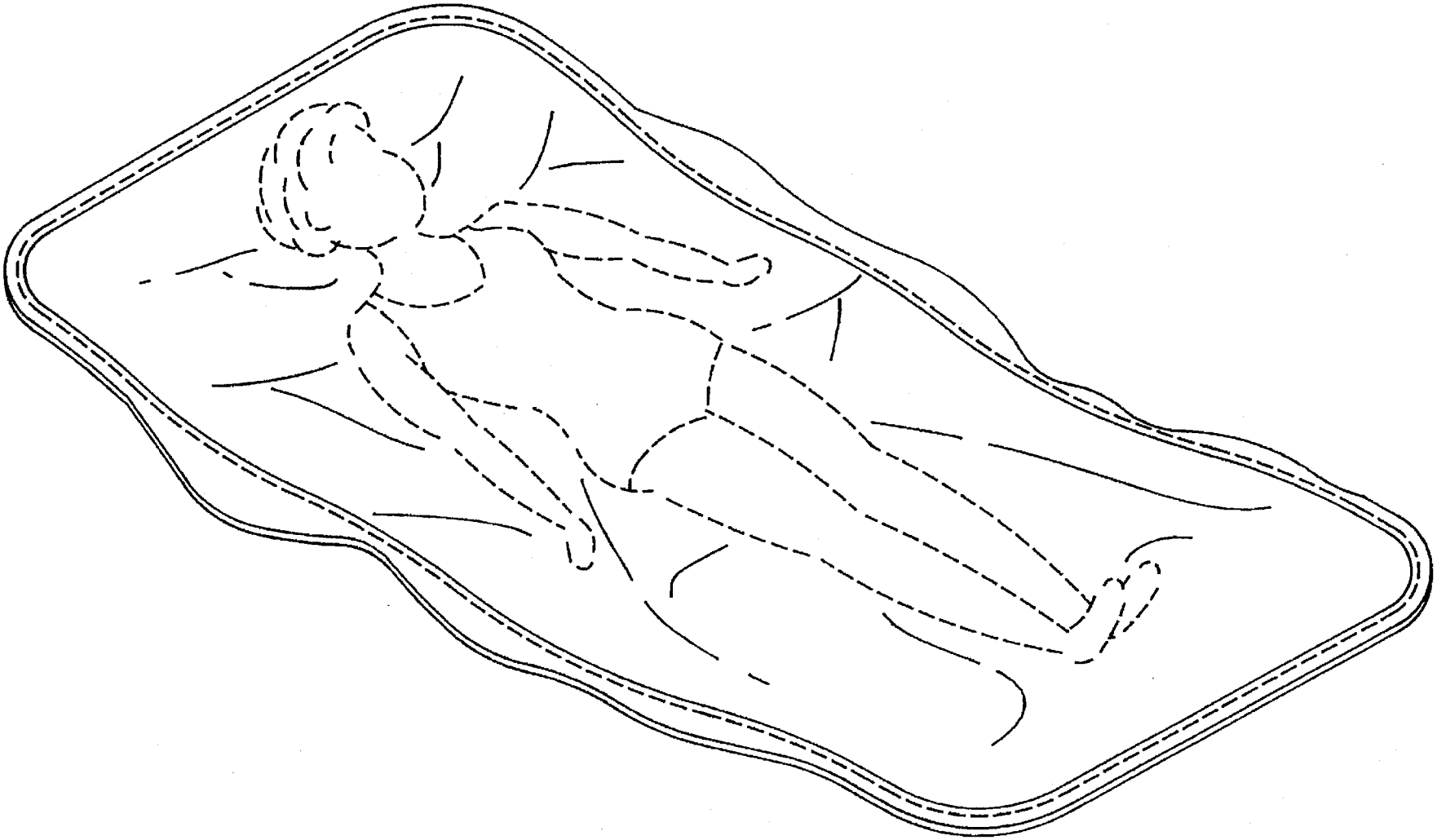
FIG. 4 is an applied view of the multipurpose flotation blanket.

Referring to FIGS. 2A and 2B again, by pulling the upper and bottom flotation layers 11 and 12 apart, a current of air is induced into the air chamber inside the blanket body 10 through the air inlet 322 and the air holes 332, causing the blanket body 10 inflated. When the blanket body 10 is inflated, the upper valve body 32 is pressed down, causing the plug rod 331 of the lower valve body 33 fitted into the inlet nozzle 321 to seal the air inlet 322. When the air valve assembly 30 is closed, the user can lie on the blanket body 10 comfortably (see FIG. 4). When not in use, the pull strip 323 is pulled outwards to separate the inlet nozzle 321 from the plug rod 331 to open the air valve assembly 30 for letting air flow out of the blanket body 10, and hen the blanket body 10 can be rolled up.

Referring to FIG. 3A again, as described, the blanket body 10 can be folded up into three folds in the longitudinal direction and then folded up into two folds in the transverse direction, and then the handle strap 24 is fastened to the loops 22 for carrying by hand.

While only one embodiment of the present invention has been shown and described, it will be understood that various modifications and changes could be made without departing from the spirit and scope of the invention.

What is claim is:

1. A multipurpose flotation blanket comprising:

a blanket body having an upper flotation layer, a bottom flotation layer peripherally sealed to said upper flotation layer and defining with said upper flotation layer an inflatable air chamber, an upper covering covered over said upper flotation layer on the outside, a bottom covering covered over said bottom flotation layer on the outside, and a hem fastened to said upper and bottom flotation layers and said upper and bottom coverings around the border by stitches, said upper and bottom flotation layers being made from an air-tight material that is floatable, said blanket body further comprising a circular air passage hole for letting air be driven into or out of said air chamber;

a handle unit having two symmetrical pairs of strips respectively fastened to said blanket body at two opposite sides to hold a respective loop, and a handle strap having two hooks at two opposite ends thereof for fastening the loops of either pair of strips together; and an air valve assembly made on the blanket body to control the passage through said circular air passage hole, said air valve assembly comprising a valve seat made inside said blanket body around said circular air passage hole, an upper valve body connected to said valve seat for controlling the passage of said circular air passage hole and having an inlet nozzle defining an air inlet and a pull member connected to said inlet nozzle on the outside, and a lower valve body fastened to said valve seat and disposed inside said air chamber and having a plug rod for fitting into said inlet nozzle to seal said air inlet and a plurality of air holes for passing of air into or out of said air chamber, said air valve assembly being closed when said plug rod is inserted into said inlet nozzle or opened when said pull member is pulled outwards to separate said inlet nozzle from said plug rod.

2. The multipurpose flotation blanket of claim 1 wherein said upper and bottom coverings are respectively made from water proof material and printed with decorative patterns.

3. The multipurpose flotation blanket of claim 1 which further comprises two carrying straps having two opposite ends fixed to two opposite long sides of said blanket body.

4. The multipurpose flotation blanket of claim 1 wherein said air valve assembly further comprises a protective ring mounted around said circular air passage hole.

5. The multipurpose flotation blanket of claim 1 wherein said upper valve body of said air valve assembly is made of flexible material.

6. The multipurpose flotation blanket of claim 1 wherein said pull member of said air valve assembly is a strip.

7. The multipurpose flotation blanket of claim 1 wherein said pull member of said air valve assembly is a lifting ring.

* * * * *